US005476338A

United States Patent [19]

Alberts

[11] Patent Number: 5,476,338

[45] Date of Patent: Dec. 19, 1995

[54] VEHICLE PARKING OR PASSAGEWAY SECURITY BARRIER

[75] Inventor: Barry Alberts, Burbank, Calif.

[73] Assignee: Build-It Engineering Company, Inc., Burbank, Calif.

[21] Appl. No.: 140,866

[22] Filed: Oct. 25, 1993

[51] Int. Cl.[6] ..... E01F 13/00

[52] U.S. Cl. ..... 404/6; 404/9; 74/89.15

[58] Field of Search ..... 404/6, 11; 74/89.14, 74/424.6, 424.8 A, 424.8 R, 425, 405; 49/49, 131; 362/812

[56] References Cited

U.S. PATENT DOCUMENTS

| | | | |
|---|---|---|---|
| 3,233,352 | 2/1966 | Projector et al. | 362/812 |
| 4,635,492 | 1/1987 | Uebelhart | 74/89.15 |
| 4,739,669 | 4/1988 | Yokose et al. | 74/89.15 |
| 4,765,651 | 8/1988 | Unger | 74/424.6 |
| 4,919,563 | 4/1990 | Stile | 404/6 |
| 4,995,278 | 2/1991 | Huang | 74/89.15 |

*Primary Examiner*—Ramon S. Britts
*Assistant Examiner*—Pamela A. O'Connor
*Attorney, Agent, or Firm*—James E. Brunton

[57] ABSTRACT

A bollard type security barrier apparatus for use in controlling ingress and egress to controlled areas. The apparatus if of simple design, is easily installed and includes a remotely operated positive drive mechanism for raising and lowering the bollard which is telescopically mounted within a sealed casing adapted to be mounted beneath the ground. The drive mechanism and the bollard are readily removable from the subterranean casing for repair or replacement; and, for certain applications, the upper portion of the bollard can be illuminated.

13 Claims, 7 Drawing Sheets

FIG. 1
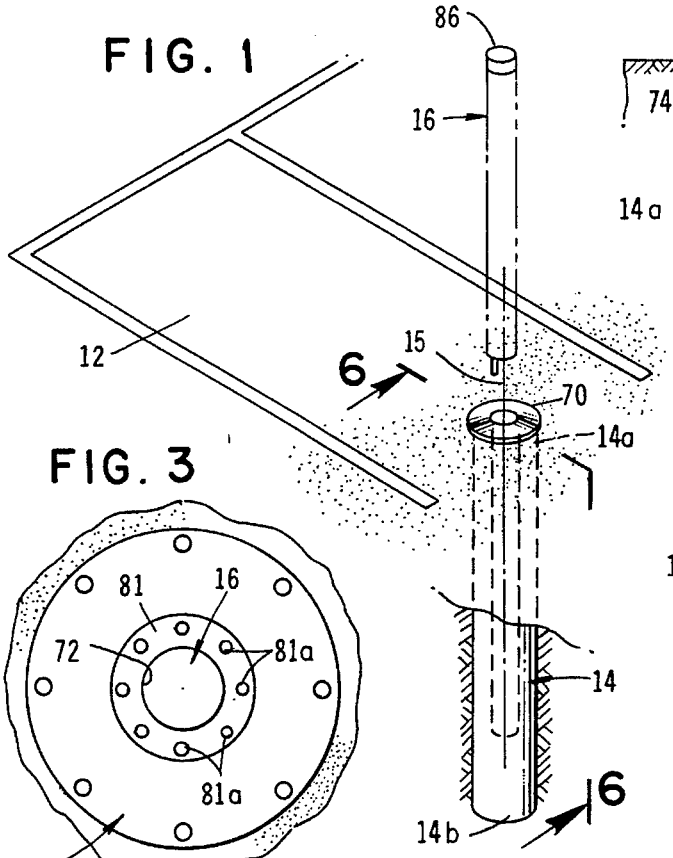
FIG. 3
FIG. 4
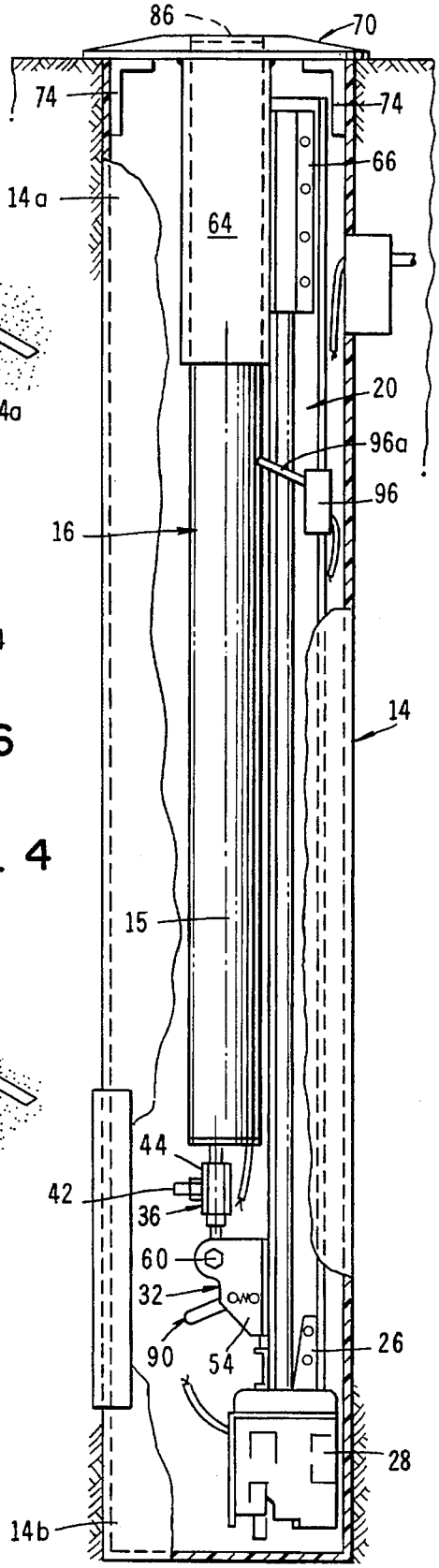
FIG. 2
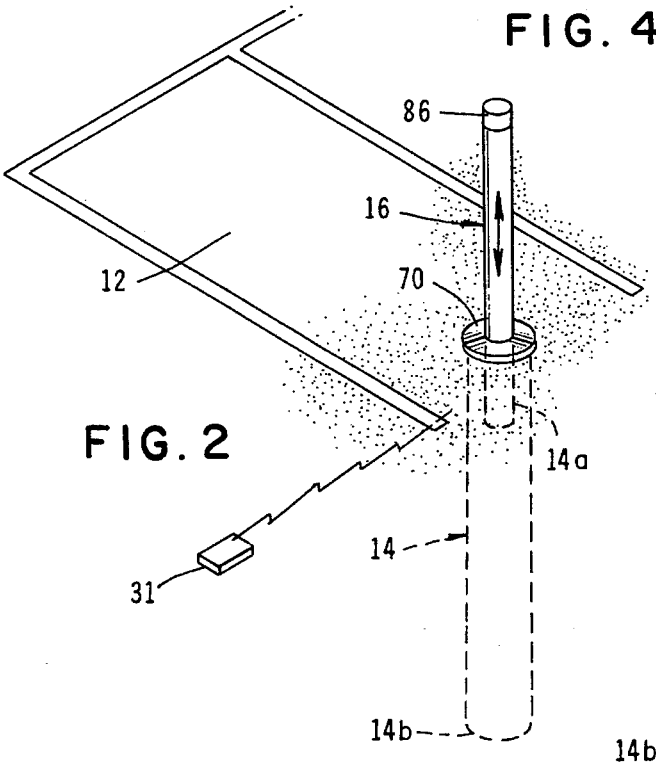

86
16
15
70
74
14a
20
64
44
42
36
60
32
90
54
96a
96
14
26
28
14b
77
81a
72
78
75
74
75
14a
7
15
80
81
81a
77
70
64
-86-
74
7
75
82
66
20
22
24
84
66
64
14
16
96a
96

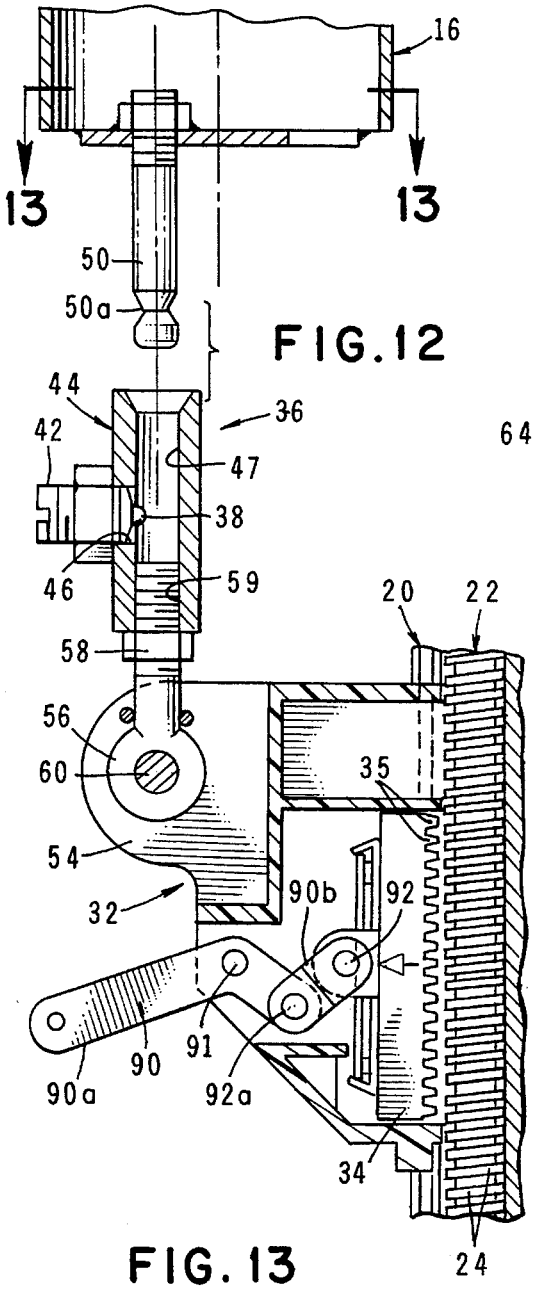
FIG. 12
FIG. 13
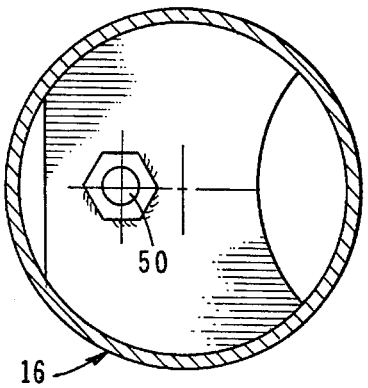
FIG. 14
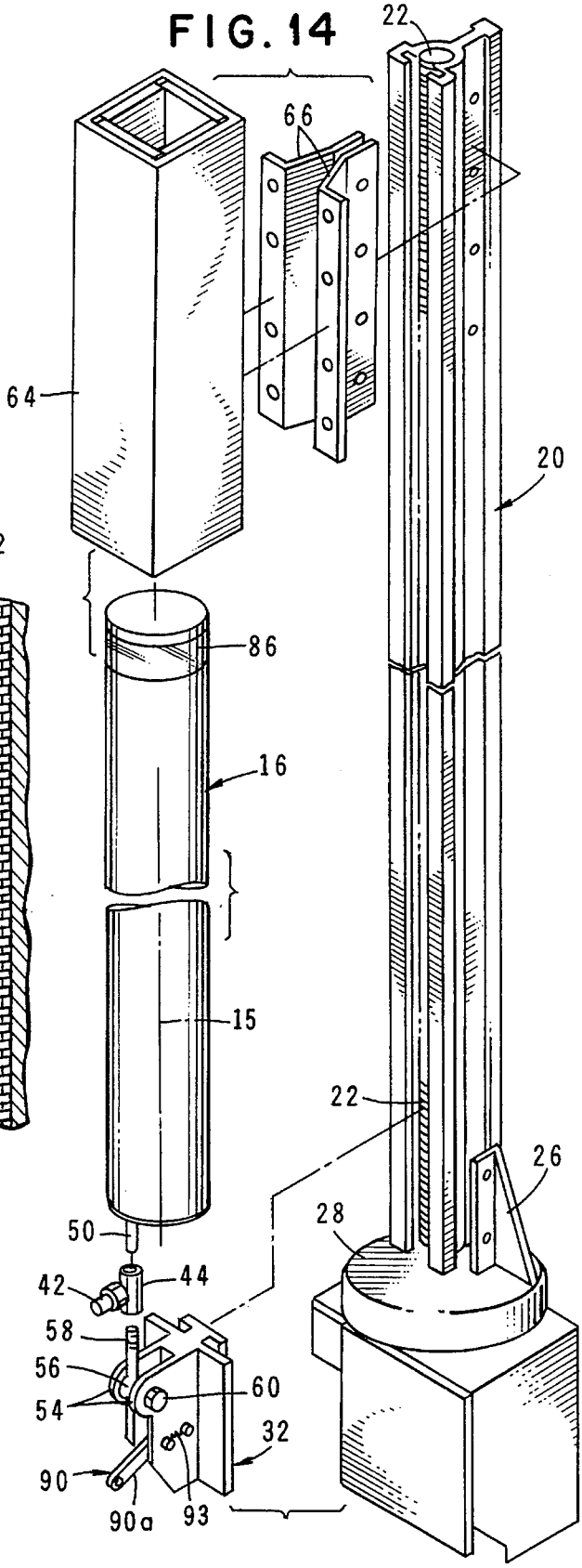

VEHICLE PARKING OR PASSAGEWAY SECURITY BARRIER

BACKGROUND OF THE INVENTION

1. Field of the Invention

The present invention relates generally to security barriers. More particularly, the invention concerns a new and improved vehicle barrier for selectively preventing ingress and egress to public and private parking areas and controlled spaces.

2. Discussion of the Invention

Various types of devices for controlling parking space access have been suggested. Many such prior art devices include some type of spring lift mechanism which is activated by a mechanical trigger. When the trigger releases the spring, a barrier of some type is erected. Exemplary of this type of device is that disclosed in U.S. Pat. No. 4,715,742 issued to Dixon.

Other types of prior art devices include bollard type barriers which are operated by a hydraulic lift. Exemplary of this type of device is that described in U.S. Pat. No. 4,576,508 issued to Dickanson. Another type of bollard barrier device is disclosed in U.S. Pat. No. 4,919,563 issued to Stice. The Stice device includes a casing which is embedded in the ground and a bollard carried within the casing that is raised and lowered by a somewhat elaborate electrically operated screw drive mechanism. The device can be remotely activated by a remote control transmitter.

As will be better appreciated from the discussion which follows, the apparatus of the present invention is of far simpler construction than the prior art devices, is easy to install and is highly reliable in use.

SUMMARY OF THE INVENTION

It is an object of the present invention to provide a novel, bollard type security barrier apparatus which is of simple design, is easily installed and includes a remotely operated positive drive mechanism for raising and lowering the bollard.

Another object of the invention is to provide an apparatus of the aforementioned character in which the bollard is telescopically mounted within a sealed casing adapted to be mounted beneath the ground.

Another object of the invention is to provide an apparatus as described in the preceding paragraph in which the drive mechanism and the bollard is readily removable from the subterranean casing for repair or replacement.

Another object of the invention is to provide an apparatus as described in which the upper portion of the bollard can be illuminated.

Still another object of the invention is to provide a security barrier apparatus which is inexpensive to manufacture and maintain but yet is highly reliable in use.

BRIEF DESCRIPTION OF THE DRAWINGS

FIG. 1 is a generally perspective, exploded view of the apparatus of the invention shown installed at the entrance to a parking space.

FIG. 2 is a generally perspective view similar to FIG. 1 showing the bollard in an elevated position.

FIG. 3 is an enlarged plan view of the apparatus.

FIG. 4 is an enlarged, side-elevational view of the apparatus partly broken away to show internal construction.

FIG. 12 is a fragmentary, cross-sectional view similar to FIG. 10 but showing the bollard assembly disconnected from the drive assembly.

FIG. 13 is a cross-sectional view taken along lines 13—13 of FIG. 12.

FIG. 14 is an exploded, generally perspective view of the internal working mechanism of the apparatus of the invention.

DESCRIPTION OF THE INVENTION

Figures 5, 6A:
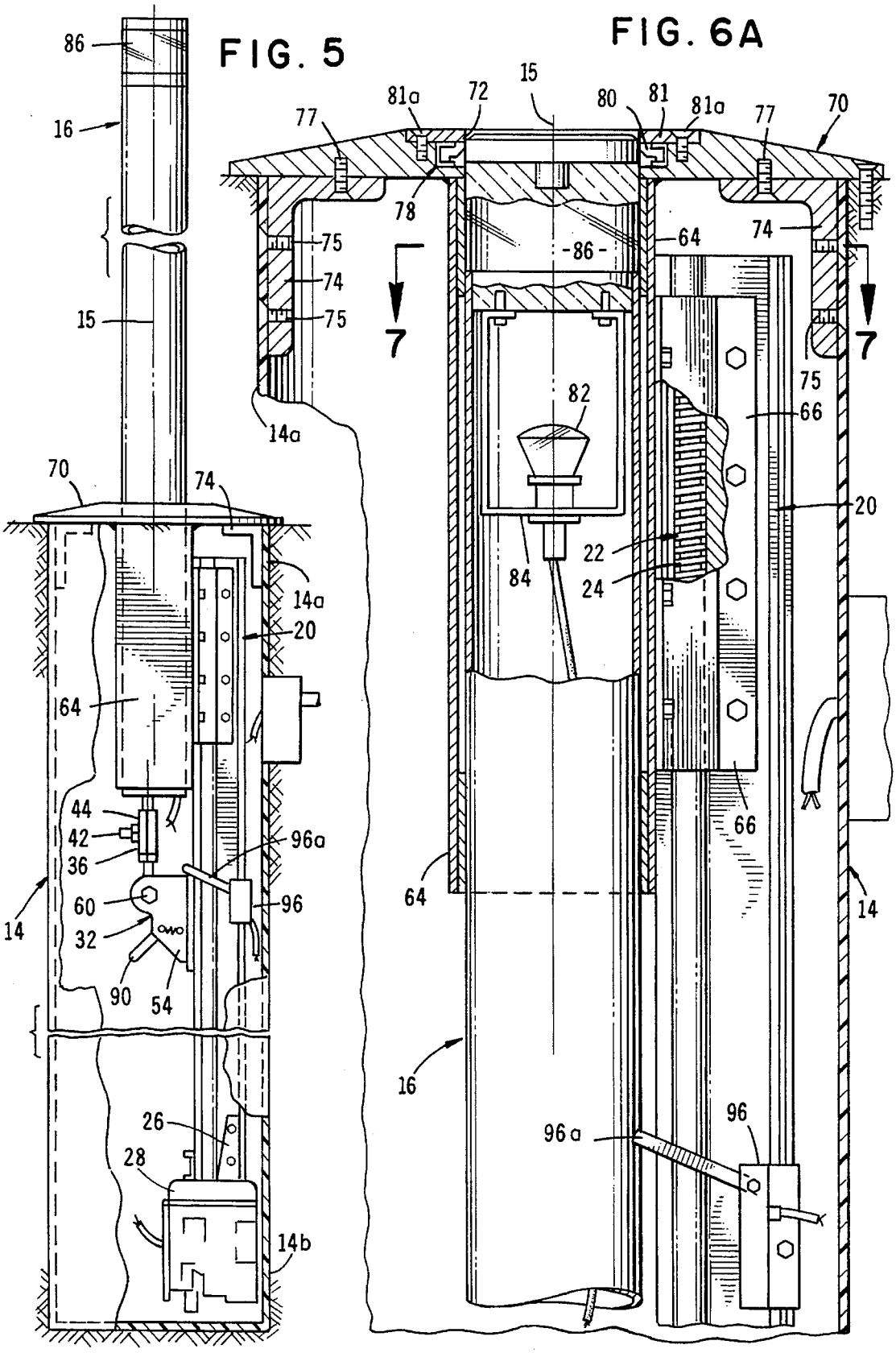
FIG. 5 is a side-elevational view similar to FIG. 4 but showing the bollard in an elevated position.
FIGS. 6*a* and 6*b* are greatly enlarged, cross-sectional views taken along lines 6—6 of FIG. 1.

Referring to the drawings and particularly to FIGS. 1 and 2, the barrier apparatus of the present invention for controlling access to controlled space such as a parking space 12 comprises a subterranean tubular casing 14 having an upper end 14*a*, a lower end 14*b* and a longitudinally extending central axis 15. A generally cylindrically bollard 16 is coaxially aligned with central axis 15 and is telescopically movable within casing 14 from a first lowered position to a second raised position. In a manner presently to be described, bollard 16 is removable from casing 14 as is illustrated in FIG. 1.

Turning to FIGS. 3 and 4, bollard 16 is moved from the first position to the second position by drive means which are disposed interiorly of casing 14. In the form of the invention shown in the drawings, the drive means comprise an elongated support member 20 which is disposed interiorly of casing 14 and is axially offset from axis 15. (see also FIG. 14). As best seen by also referring to FIG. 6*a* and 6*b*, the drive means further comprises an elongated worm gear or lead screw 22 having spiral teeth 24 provided along its length.

Figure 6B:
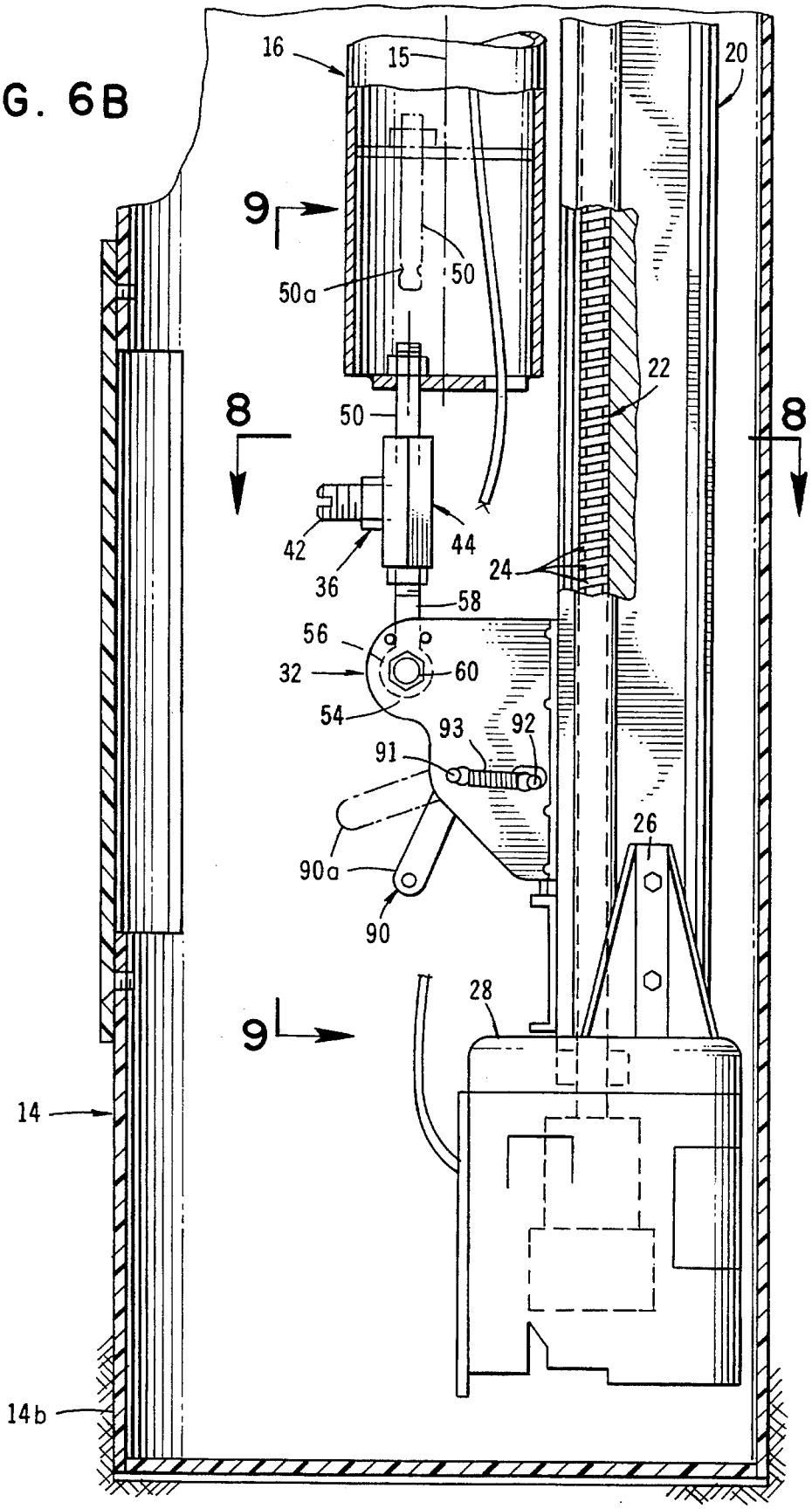

Mounted at the bottom of support 20 by suitable braces 26 is motor means for controllably rotating worm gear or lead screw 22. In the present embodiment of the invention, the motor means comprises an electric motor 28 having a drive shaft suitably interconnected with lead screw 22 so as to rotate the lead screw at a controlled rate of speed upon energizing motor 28. As best seen in FIG. 6*a*, the longitudinal axis of lead screw 22 is also transversely spaced apart from the longitudinal axis 15 of bollard 16. In a manner well understood by those skilled in the art, motor 28 can be remotely energized by a transmitter 31 (FIG. 2).

Figure 10:
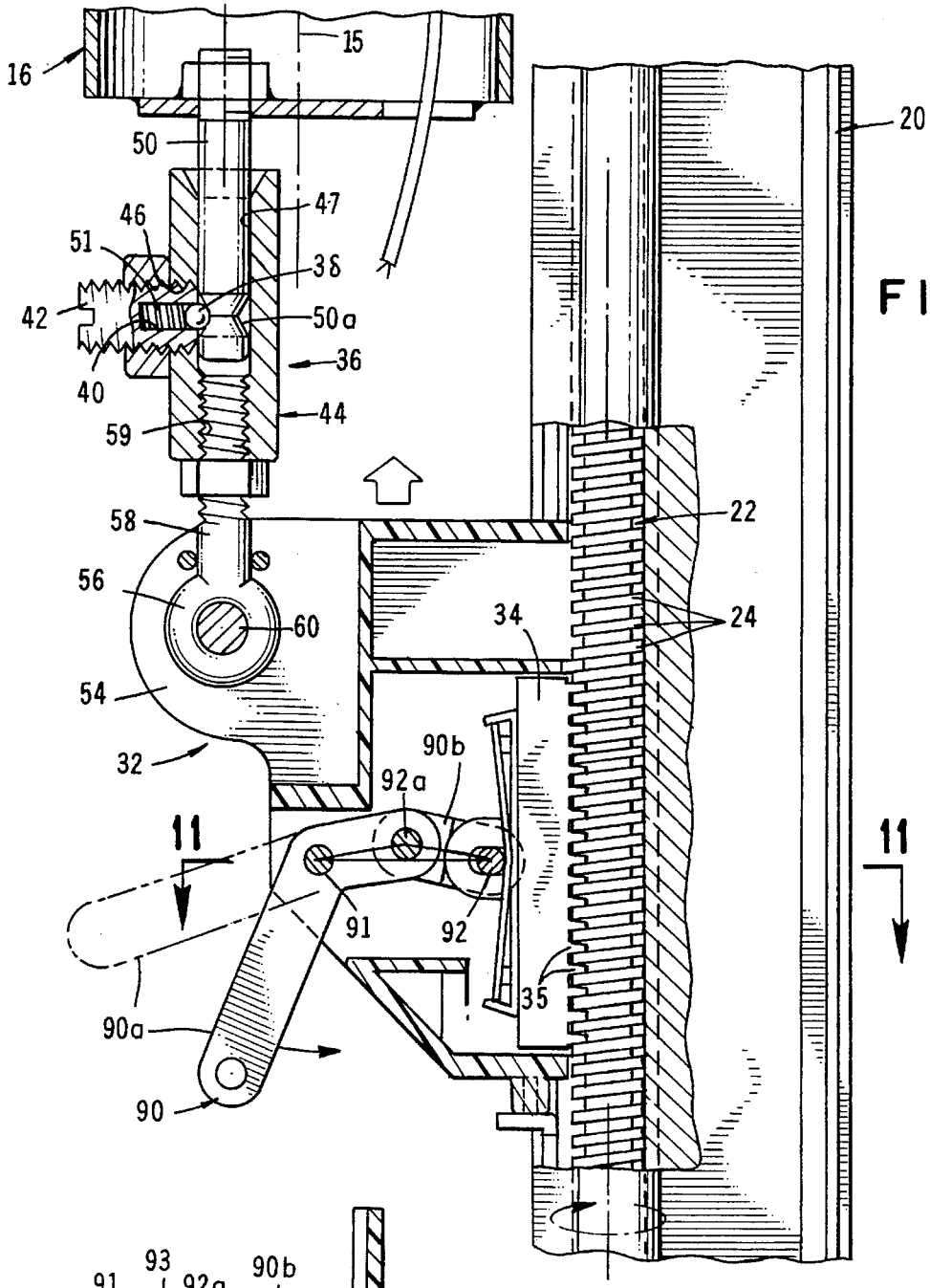
FIG. 10 is a greatly enlarged, fragmentary side-elevational view of the lower portion of the apparatus partly broken away to show internal construction.
Figure 11:
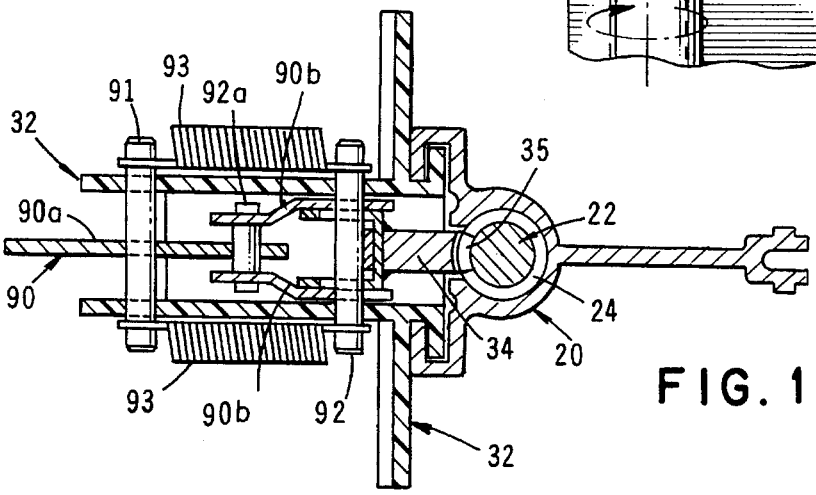
FIG. 11 is a cross-sectional view taken along lines 11—11 of FIG. 10.

Turning now to FIGS. 10, 11 and 12, the drive means of this form of the invention further comprises a rack assembly generally designated by the numeral 32. Rack assembly 32 includes a rack 34 having outwardly protruding teeth 35 adapted to mateably engage teeth 24 of lead screw 22. Rack assembly 32 also includes moving means for controllably moving rack 34 from a first position in engagement with lead screw 22 (FIG. 10) to a second position wherein rack 34 is spaced apart and disengaged from lead screw 22 (FIG. 12). The construction of this moving means will presently be described.

Also forming a part of the drive means of the invention is connector means for releasably interconnecting the bollard 16 with rack assembly 32 so as to cause movement of the bollard from the first lowered position to the raised second position. As best seen in FIG. 10, this connector means here comprises a detent assembly 36 including a spring loaded detent member 38 which carried within a bore 40 provided in an externally threaded plug 42. Plug 42 is in turn threadably interconnected with a sleeve member 44 which includes an internally threaded passageway 46. So that bollard 16 can be connected with the connector means, the bollard is provided with a downwardly depending shaft 50 having a grooved portion 50*a*. Shaft 50 is closely receivable within a longitudinally extending passageway 47 formed in sleeve 44 and is removably locked in position therewithin by detent member 38 which is urged into groove 50*a* by the force of a coiled spring 51. Spring 51 is selected so that a sufficient force is exerted on member 38 to effectively resist separation of shaft 50 from bore 47 until an upward force is exerted on bollard 16 sufficient to cause the detent member 38 to retract against the urging of spring 40 thereby permitting shaft 50 to be removed from bore 47 in the manner illustrated in FIG. 12.

Figure 9:
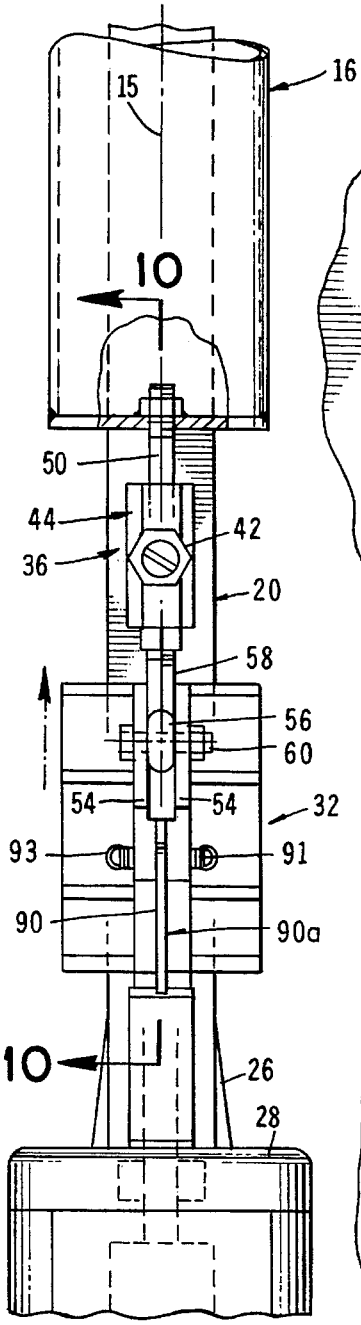
FIG. 9 is a view taken along lines 9—9 of FIG. 6*b*.
Figure 7:
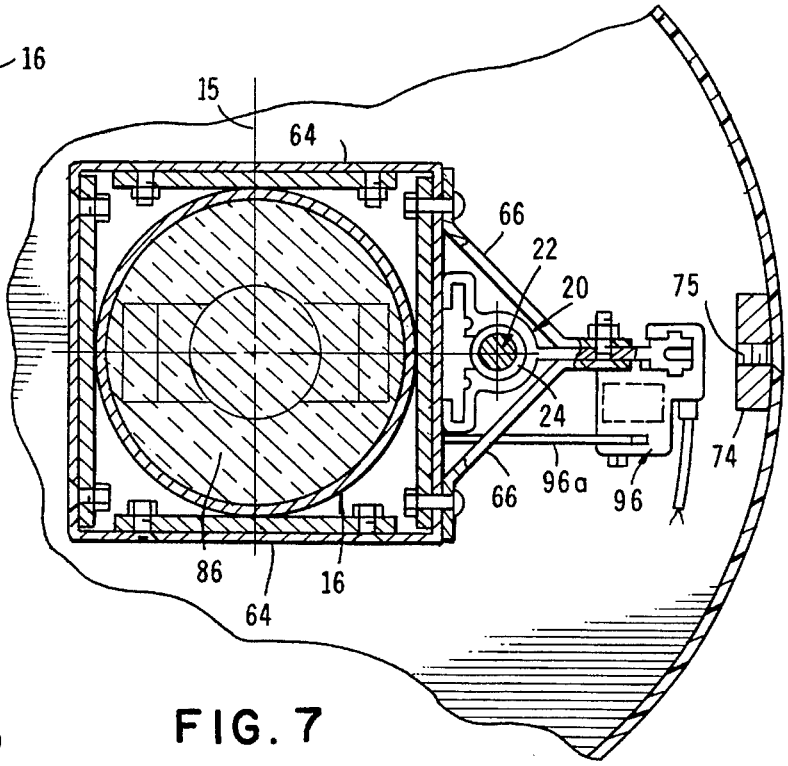
FIG. 7 is a cross-sectional view taken along lines 7—7 of FIG. 6*a*.
Figure 8:
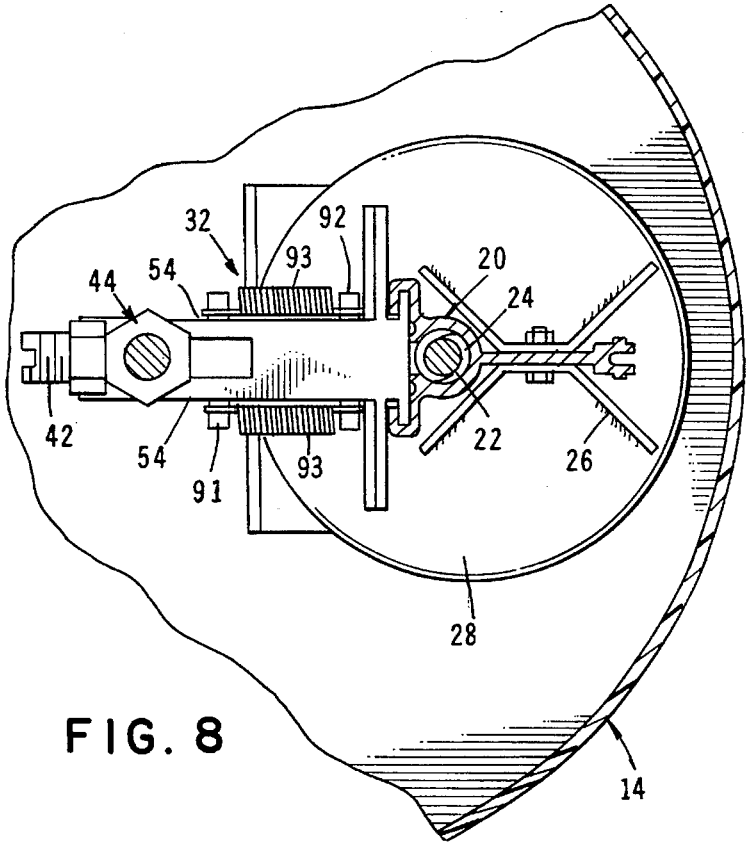
FIG. 8 is a cross-sectional view taken along lines 8—8 of FIG. 6*b*.

As indicated in FIG. 9, rack assembly 32 includes spaced apart walls 54 (see also FIG. 8) which are adapted to receive therebetween an eyelet portion 56 of threaded connector 58. Threaded connector 58 is, in turn, threadably interconnectable with sleeve 44 in the manner shown in FIG. 10 by means of internal threads 59 provided at the lower end of bore 47. Eyelet portion 56 is adapted to receive a connector bolt 60 which passes through walls 54 and the central opening of eyelet 56 so as to removably interconnect the detent assembly with the rack assembly housing.

Forming an important aspect of the present invention is guide means for guiding movement of bollard 16 between its lowered and raised positions. As best seen in FIG. 14, the guide means here comprises a square tube 64 which is interconnected to support member 20 by means of brackets 66. Square tube 64 is mounted within tubular casing 14 in coaxial alignment with the longitudinal axis of the casing and in coaxial alignment with the longitudinal axis 15 of bollard 16. Guide means 64 not only functions to guide the vertical travel of the bollard, but also provides substantial support against side forces which may be exerted on the bollard when the bollard is in its raised position.

Forming another important feature of the apparatus of the invention is closure means for closing the upper end of casing 14 to prevent water and other contaminants from entering the interior of the casing. As best seen in FIG. 6*a*, the closure means is here provided in the form of an annular shaped plate 70 having a central aperture 72 which is adapted to closely receive bollard 16 as it reciprocates within the guide means or square tube 64. Plate 70 is affixed as by welding to the upper end of square tube 64. Depending downwardly from plate 70 is a connector ring 74 which is closely receivable within the top open end of casing 14 and is interconnected therewith by appropriate connectors 75. Ring 74 is, in turn, interconnected with plate 70 by means of appropriate connectors 77.

Figure 15:
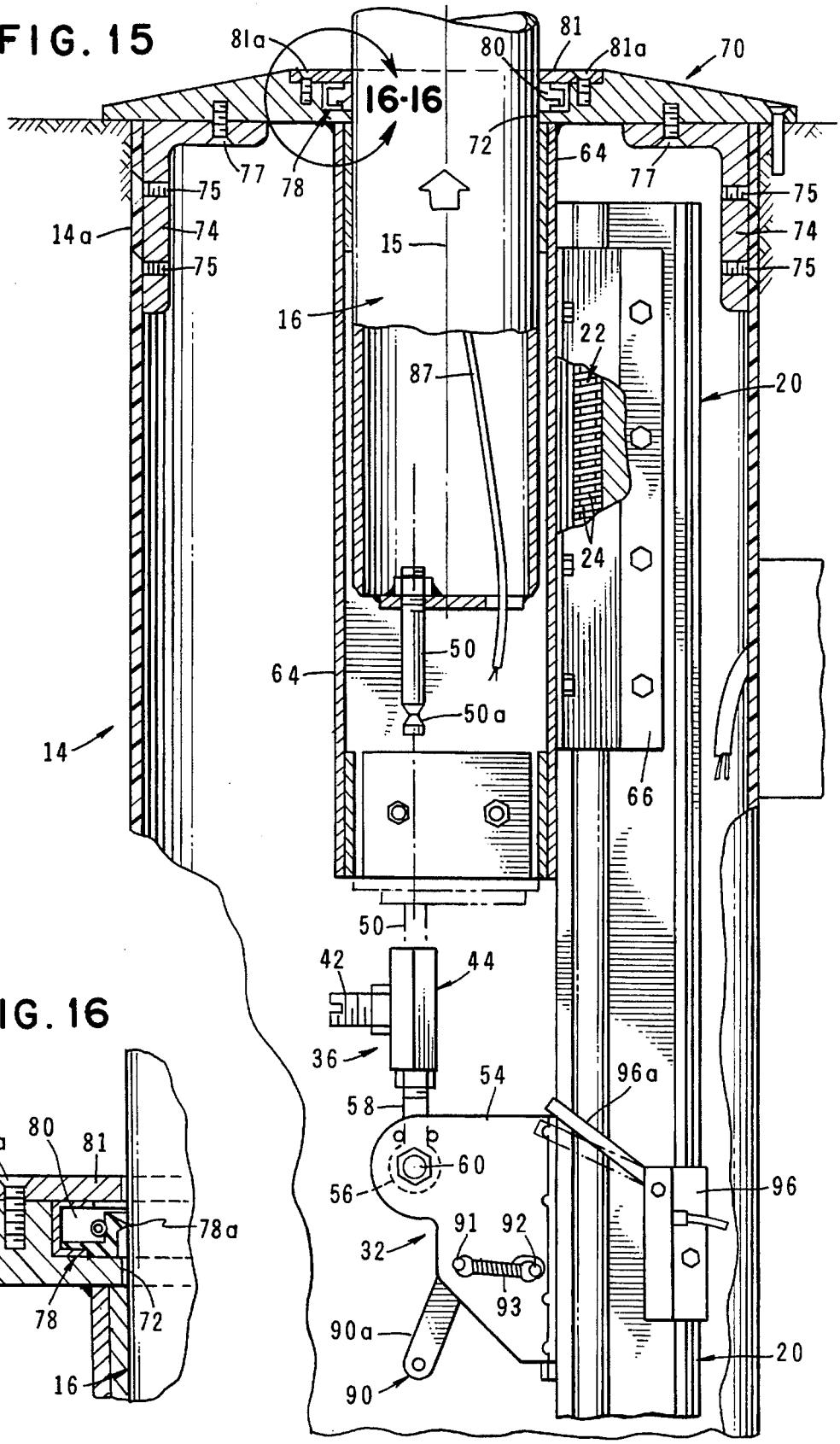
FIG. 15 is a fragmentary, side-elevational view similar to FIG. 5 but showing the bollard in an upraised position.
Figure 16:
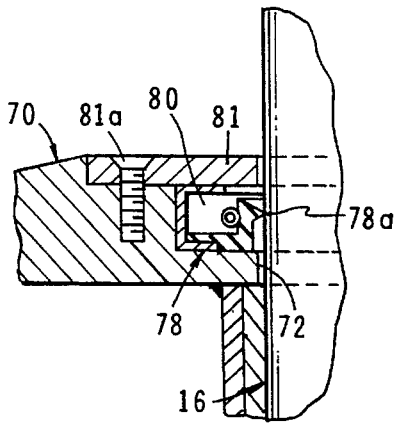
FIG. 16 is a fragmentary view of area 16—16 of FIG. 15 showing the sealing member of the invention in greater detail.

To prevent leakage between central aperture 72 and bollard 16, there is provided sealing means in the form of a resiliently deformable, elastomeric member 78 which is generally U shaped in cross section and is carried within an annular recess 80 formed in plate 70 (see FIGS. 15 and 16). Elastomeric member 78 is held in place within recess 80 by an annular plate 81 which is connected to plate 70 by fasteners 81*a* and is provided with a radially inwardly extending lip 78*a* which is adapted to sealably contact the outer surface of bollard 16 in the manner best seen in FIG. 16.

Also forming a unique feature of the apparatus of the present invention is illumination means for illuminating bollard 16 when the bollard is in its upraised position. The illumination means is here provided as an electric light 82 which is carried within a housing 84 which is mounted within bollard 16 proximate the top portion thereof (see FIG. 6*a*). Housing 84 is provided is a translucent plastic cover 86 which is illuminating by light 82 when the light is energized by suitable wiring 87 (FIG. 15) connecting the light to a source of electricity (not shown).

Turning once again to FIGS. 10, 11 and 12, rack assembly 32 is provided with means for manually moving rack 34 into engagement with worm gear 22. This means here comprises a linkage assembly 90 made up of a handle portion 90*a* and a toggle link 90*b* to which rack 34 is connected by means of a connector element 92 (FIG. 11). As indicated in FIG. 12, when handle member 90*a* is in the upward position there shown, rack 34 is spaced apart from lead screw 22. However, a downward force exerted on handle 90*a* in the manner indicated in FIG. 10 will cause the handle to pivot upwardly about pivot pin 91 and linkage 90*b* to pivot upwardly about pivot element 92 and pin 92*a* in the manner shown in FIG. 10 urging rack 34 inwardly toward lead screw 22 against the urging of springs 93 so as to cause teeth 35 to mesh with teeth 24 of the lead screw.

In operation, with bollard 16, in the downward position, the user can drive into parking space 12 without interference. Upon energization of motor 28 using remote control transmitter 31, lead screw 22 will rotate causing rack 34, which is normally in contact with the lead screw, to move upwardly along the lead screw. This, of course, causes bollard 16 to move telescopically upward. When the bollard reaches its uppermost position, as shown in FIGS. 2 and 5, contact arm 96*a* of a limit switch 96 (FIGS. 5 and 15) will engage assembly 32 causing deenergization of motor 28 and illumination of light 86. With the bollard raised, egress from parking space 12 is prevented. When the user wishes to exit the parking space, motor 28 is once more energized by transmitter 31. This time, however, due to the design of the electrical circuitry, the lead screw will be rotated in the opposite direction causing rack 34 and bollard 16 to move downwardly. When the bollard reaches its downward most position, the circuitry will automatically de-energize the motor and extinguish the light.

Having now described the invention in detail in accordance with the requirements of the patent statutes, those skilled in this art will have no difficulty in making changes and modifications in the individual parts or their relative assembly in order to meet specific requirements or conditions. Such changes and modifications may be made without departing from the scope and spirit of the invention, as set forth in the following claims.

I claim:

1. A barrier apparatus for controlling access to a controlled space comprising:

(a) a subterranean tubular casing having an upper end, a lower end and extending central axis;

(b) a cylindrically shaped bollard coaxially aligned with said central axis and being telescopically movable within said casing between a first lowered position and a second raised position;

(c) drive means disposed interiorly of said casing for controllably moving said bollard between said first and second positions, said drive means comprising:

(i) an elongated support disposed interiorly of said casing;

(ii) an elongated worm gear having a longitudinally extending axis, transversely spaced apart from said central axis of said casing;

(iii) an electric motor means connected to said worm gear for controllably rotating said worm gear;

(iv) a rack assembly including a rack having teeth matably engagable with said worm gear; and (v) connector means for connecting said bollard to said rack assembly of said drive means; and (d) guide means connected to said drive means for guiding movement of said bollard between said first and second positions, said guide means comprising a square tube connected to said elongated support of said drive means; and (e) closure means for closing said upper end of said casing, said closure means comprising a plate connected to said square tube member, said plate having a central aperture for closely receiving said bollard.

2. A barrier apparatus for controlling access to a controlled space comprising:

(a) a casing having an upper end, a lower end and longitudinally extending central axis;

(b) a bollard coaxially aligned with said central axis and being telescopically movable within said casing between a first lowered position and a second raised position;

(c) drive means disposed interiorly of said casing for controllably moving said bollard between said first and second positions, said drive means comprising:

(i) an elongated worm gear having a longitudinally extending axis, said worm gear being located within said casing so that said axis thereof is transversely spaced apart from said central axis of said casing:

(ii) motor means connected to said worm gear for controllably rotating said worm gear;

(iii) a rack assembly including a rack having teeth matably engagable with said worm gear said rack assembly comprising a moving means for controllably moving said rack toward and away from said worm gear for engagement and disengagement of said rack with said worm gear; and (iv) connector means for connecting said bollard to said rack assembly of said drive means; and (d) guide means connected to said drive means for guiding movement of said bollard between said first and second positions.

3. A barrier apparatus for controlling access to a controlled space comprising:

(a) a casing having an upper end, a lower end and longitudinally extending central axis;

(b) a bollard coaxially aligned with said central axis and being telescopically movable within said casing between a first lowered position and a second raised position, said bollard including a grooved shaft;

(c) drive means disposed interiorly of said casing for controllably moving said bollard between said first and second positions, said drive means comprising:

(i) an elongated worm gear having a longitudinally extending axis, said worm gear being located within said casing so that said axis thereof is transversely spaced apart from said central axis of said casing:

(ii) motor means connected to said worm gear for controllably rotating said worm gear;

(iii) a rack assembly including a rack having teeth matably engagable with said worm gear said rack assembly comprising a detent assembly releasably engagable with said grooved shaft of said bollard; and (iv) connector means for connecting said bollard to said rack assembly of said drive means; and (d) guide means connected to said drive means for guiding movement of said bollard between said first and second positions.

4. An apparatus as defined in claim 3 further including an elongated support means for supporting said worm gear.

5. An apparatus defined in claim 4 in which said motor means comprises an electric motor connected to said elongated support means, said electric motor having a driving shaft connected to said elongated worm gear.

6. An apparatus as defined in claim 4 in which said guide means comprises a tubular member connected to said elongate support means.

7. An apparatus as defined in claim 6 further including closure means for closing said upper end of said casing, said closure means comprising a plate connected to said tubular member, said plate having a central aperture for closely receiving said bollard.

8. An apparatus as defined in claim 7, further including sealing means for sealably engaging said bollard.

9. An apparatus as defined in claim 7 further including means for releasably connecting said plate to said casing.

10. A barrier apparatus for controlling access to a controlled space comprising:

(a) a subterranean tubular casing having an upper end, a lower end and extending central axis;

(b) a cylindrically shaped bollard coaxially aligned with said central axis and being telescopically movable within said casing between a first lowered position and a second raised position;

(c) drive means disposed interiorly of said casing for controllably moving said bollard between said first and second positions, said drive means comprising:

(i) an elongated support disposed interiorly of said casing;

(ii) an elongated worm gear having a longitudinally extending axis, transversely spaced apart from said central axis of said casing;

(iii) an electric motor means connected to said worm gear for controllably rotating said worm gear;

(iv) a rack assembly including a rack having teeth matably engagable with said worm gear, said rack assembly further including means for manually moving said rack into mating engagement with said worm gear; and (v) connector means for connecting said bollard to said rack assembly of said drive means; and (d) guide means connected to said drive means for guiding movement of said bollard between said first and second positions, said guide means comprising a square tube connected to said elongated support of said drive means; and (e) closure means for closing said upper end of said casing, said closure means comprising a plate connected to said square tube member, said plate having a central aperture for closely receiving said bollard.

11. An apparatus as defined in claim 10 further including sealing means for sealably engaging said bollard, said sealing means comprising a resiliently deformable elastomeric member carried by said plate proximate said central aperture.

12. An apparatus as defined in claim 10 further including means for releasably connecting said plate to said casing.

13. An apparatus as defined in claim 10 in which said bollard includes illumination means for illuminating said bollard when said bollard is in said second raised position.

* * * * *